US005740753A

United States Patent [19]

Theophanis

[11] Patent Number: 5,740,753

[45] Date of Patent: Apr. 21, 1998

[54] METHOD OF FABRICATING BUOYANT PRESTRESSED CONCRETE BUILDING MODULES, RESULTING MODULES, AND ASSEMBLY THEREOF

[76] Inventor: Peter M. Theophanis, 319 Old Jupiter Rd., Jupiter, Fla. 33477

[21] Appl. No.: 547,148

[22] Filed: Oct. 24, 1995

[51] Int. Cl.[6] ..... B63B 35/44

[52] U.S. Cl. ..... 114/267; 114/263; 52/578; 29/452

[58] Field of Search ..... 405/218, 219, 405/220, 221; 114/263, 264, 266, 267; 52/578, 601; 29/452

[56] References Cited

U.S. PATENT DOCUMENTS

| | | | |
|---|---|---|---|
| 3,952,468 | 4/1976 | Soum | 52/227 |
| 4,365,914 | 12/1982 | Sluys | 114/267 |
| 4,453,488 | 6/1984 | Watchorn | 114/266 |
| 5,297,899 | 3/1994 | Culley | 114/266 |
| 5,402,616 | 4/1995 | Klein | 52/601 |

*Primary Examiner*—Stephen Avila
*Attorney, Agent, or Firm*—Robert J. Van Der Wall

[57] ABSTRACT

The method, operated in the manner of a production line involving fabrication of a plurality of modules, includes, as to each module, the steps of preparing a bed having the desired module shape and size; preparing a galvanized welded wire fabric or mesh; fitting said wire fabric along the floor and sidewall interior surfaces of the bed to begin building an infrastructure; installing and tying epoxy coated reinforcing bars, inserts, reinforcing plates, post-tensioning tubes and other reinforcing steel within said infrastructure; installing pre-stressing strand along floor and sidewall interior surfaces; applying tensile loading to the pre-stressing strands with a hydraulic jack and deadhead apparatus; pouring a layer of concrete on the floor of the bed; seating foam billets within billet receiving sections adjacent to the wire fabric and between the post-tensioning tubes; fitting wire fabric along said interior deck to build the remainder of the infrastructure; installing and tying epoxy coated reinforcing bars and other reinforcing steel within the interior deck portion of the infrastructure and connecting the same to the sidewall infrastructure; installing pre-stressing strand along the interior deck portion of the infrastructure; applying tensile loading to the interior deck pre-stressing strands with the hydraulic jack and deadhead apparatus; pouring cement mix into the bed around and over the foam billets; applying a smooth brush finish to the module; permitting the cement mix to cure; cutting the pre-stressing strand ends; and removing the module from the bed.

12 Claims, 10 Drawing Sheets

METHOD OF FABRICATING BUOYANT PRESTRESSED CONCRETE BUILDING MODULES, RESULTING MODULES, AND ASSEMBLY THEREOF

BACKGROUND OF THE INVENTION

1. Field of the Invention

The present invention relates generally to the field of building modules for constructing various floating structures. More specifically, the present invention relates to a method of fabricating buoyant building modules using prestressed concrete for supporting structures, which may include restaurants, bridges, breakwater devices and the like. The method, operated in the manner of a production line involving fabrication of a plurality of modules, includes, as to each module, the steps of preparing a bed having the desired module shape and size; preparing a galvanized welded wire fabric or mesh; fitting said wire fabric along the floor and sidewall interior surfaces of the bed to begin building an infrastructure; installing and tying epoxy coated reinforcing bars ("re-bars"), inserts, reinforcing plates, post-tensioning tubes and other reinforcing steel within said infrastructure; installing pre-stressing strands along floor and sidewall interior surfaces; applying tensile loading to the pre-stressing strands with a hydraulic jack and deadhead apparatus; pouring a layer of concrete on the floor of the bed; searing foam billets within billet receiving sections adjacent to the wire fabric and between the post-tensioning tubes; preparing a further galvanized welded wire fabric or mesh for the interior deck over the foam billets; fitting said wire fabric along said interior deck to build the remainder of the infrastructure; installing and tying epoxy coated reinforcing bars and other reinforcing steel within the interior deck portion of the infrastructure and connecting the same to the sidewall infrastructure; installing pre-stressing strand along the interior deck portion of the infrastructure; applying tensile loading to the interior deck pre-stressing strands with the hydraulic jack and deadhead apparatus; pouring cement mix into the bed around and over the foam billets; applying a smooth brush finish to the module; permitting the cement mix to cure; cutting the pre-stressing strand ends; and removing the module from the bed.

A method of assembling modules formed according to the invention includes the steps of transporting a plurality of the modules to a floating structure assembly site; juxtaposing the modules such that the post-tensioning tubes of laterally adjacent modules are mutually aligned; inserting post-tensioning means, which include Gables or rods, through the tubes; applying tension to the post-tensioning means with a hydraulic tensioning tool; and anchoring the post-tensioned means in place. This may be done with pilings that may be driven into the seabed at the building site.

A building module is also provided as produced by the above method of manufacture. The module includes a linear series of spaced apart foam billets, each foam billet of the series being surrounded by concrete to both encase and interconnect the foam billets. The concrete contains a galvanized welded wire fabric. More importantly, the concrete also contains pre-stressed strands, preferably extending longitudinally within the module along and through the wire fabric. The concrete also preferably contains reinforcing bars. Post-tensioning tubes are embedded in the concrete and preferably pass laterally through the module at both ends and between foam billets. If the modules are to be anchored at the building site, a piling receiving notch may be recessed into the concrete at one or both end walls of the module. In that event, bumper material such as neoprene is preferably provided along the side and end walls of the module to protect abutting modules from impact and abrasion damage. A polyethylene material is provided within the notches to permit safe abutment of pilings. The pilings are driven into the seabed using the module assembly as a template. The module assembly can be anchored by either pilings or a mooring configuration utilizing nylon lines and/or chains which is anchored with concrete blocks.

2. Description of the Prior Art

Several patents have issued for various inventions in this general field of endeavor. These include Sluys, U.S. Pat. No. 4,365,914, issued on Dec. 28, 1982, which discloses a transverse post-tensioned tendon interconnecting system for marine floats. Sluys includes a marine float having a concrete outer shell containing a plastic foam core and conduits extending laterally through the core and the concrete shell. The conduits contain axially resilient, thin wale securing tendons. The ends of each tendon are threaded and are fitted with a nut and washer which are tightened to bear against and secure a wale member along a side of the concrete shell. The tendons are thin so that they can stretch and contract with wet expansion and dry contraction of the wale, while maintaining securing tension on the wale. The tendon is contained within a threaded steel tube to withstand sheer forces between the wale member and the concrete shell. A problem with Sluys is that it does not teach a way of reinforcing the concrete shell itself, so that the marine float remains subject to impact failure. Another problem is that the thin tendons are too weak to hold two concrete marine floats together.

Sluys, U.S. Pat. No. 4,318,361, issued on Mar. 9, 1982, reveals a lightweight concrete marine float and method of constructing the float. This Sluys float includes a rigid concrete shell surrounding a buoyant core of foam such as polystyrene. The shell deck is formed of standard aggregate concrete. The shell bottom is formed of foam aggregate concrete, and is surrounded by lower end and side walls which are integrally formed with the bottom. The foam aggregate concrete bottom is less dense than water, so that an upward force is exerted on the core by the bottom, maintaining the side walls and bottom in compression rather than in tension. This compression is intended to enhance the strength of the concrete shell. Transverse reinforcing ribs are integrally formed with the deck and contain conduits. These conduits receive rigid tie bars to which elongated wales are secured in order to fasten several floats together. Sluys takes a step in the direction of increasing the strength of a concrete module shell by maintaining the shell at a very slight compression. A problem with Sluys is that the very minimal compression created by a buoyant lower layer only negligibly strengthens the concrete shell. Another problem with Sluys is that the conduits for the tie bars are all at the top of the float, which permits interconnected floats to pivot apart a their bottom portions and subjects the tie bars to possible fatigue and bending failure.

Rytand, U.S. Pat. No. 5,347,948, issued on Sep. 20, 1994, teaches a panelized float system. Rytand discloses a floating dock module including four parallel and laterally spaced apart rib beams upright in width. Compression plates of plywood extend between the beams adjacent the beam upper and lower edges and are held in compression by tie rods running laterally through the beams and secured at each end with a nut and a washer. An upper plywood face is secured across the top edges of the beams, and the upper portions of spaces between the beams and the compression plates are partially filled with foam material. The remaining lower portions of these spaces receive water to act as ballast. A problem with Rytand is that plywood, even if treated to resist the elements, deteriorates and fails in just a few years, from rotting, de-lamination and waterlogging. The standing water trapped as ballast aggravates this problem. Such constructions are also vulnerable to impact damage, such as may occur in a storm. Another problem with Rytand is that wood and foam have relatively minimal mass and thus are inefficient in damping wave action.

Culley, U.S. Pat. No. 5,297,899, issued on Mar. 29, 1994, teaches a modular floating environmental mooring system. The Culley system includes a central docking structure in the bed of an annular polygon having removably attached leg portions extending radially from each lateral side of the polygon. The central docking structure and leg portions are wooden or sheet metal boxes containing plastic foam material, and having an elastomeric outer coating to protect them from the elements. An anchor chain extends from the remote end of each leg portion so that several anchors secure the mooring system to the seabed. Boats can be moored between the leg portions. A problem with Culley is that elastomeric coatings have limited lives when continually exposed to the sun. Failure of this coating exposes steel boxes to corrosion failure, and wooden boxes to rot and de-lamination failure. Another problem, once again, is that a sheet metal or wooden box filled with plastic foam has minimal mass and thus bobs with wave action, providing minimal wave damping and wave breaking.

Watchorn, U.S. Pat. No. 4,453,488, issued on Jun. 12, 1984, reveals a connector for joining structural components, such a floating wharfs. Watchorn includes mounting pockets recessed into the upper surfaces of abutting floating components, the pockets forming wall portions adjacent the component abutting surfaces. An anchor bolt mounting bore extends through each wall portion, and the mounting bores are mutually aligned. Tube members line the bores and terminate in outer bore flanges extending radially around the periphery of each bore entrance. An anchor bolt is fitted through the bores, and resilient annular compression members are fit around the two protruding ends of the bolt. A washer is placed over the compression members and nuts are screwed onto the two threaded ends of the bolt to compress the compression members and thus generate force driving one component against the other. This design is intended to permit some movement between the components resulting from wave action and yet hold them securely together. A problem with Watchorn is that the concrete wall portions through which the anchor bolts extend can only withstand a limited level of loading in sheer before they fracture. Watchorn overlooks the benefits of loading concrete only in compression where possible. Another problem with Watchorn is that the recessed pockets are likely to retain debris and water which could corrode the anchor bolts. Still another problem with Watchorn is that it does not teach a complete buoyant building module.

Soum, U.S. Pat. No. 3,952,468, issued on Apr. 27, 1976, discloses the assembly of prefabricated prestressed concrete elements with the use of a post-stressing link means. Soum includes an assembly of prefabricated, pre-stressed reinforced concrete elements which are solid with their reinforcements and include linking means with at least one internally threaded cage and nuts in the cage, mounted on externally threaded parts directly or indirectly rigidly coupled to the reinforcements. The nuts abut against the cages by means of ball-and-socket bearings, thus making allowance for any misalignments of the elements. Since the reinforcements are solid with the concrete, this linking means provides for supplemental adjustment stress in particular elements only, so that the assembly may be rendered statically indeterminate.

Burtelson, U.S. Pat. No. 3,762,027, issued on Oct. 2, 1973, discloses a method of post-tensioning prestressed concrete. Burtelson teaches placing a pre-out length of cable between a dead anchor and a live anchor. Cement is poured between the anchors and permitted to cure. A truncated and hollow cone-shaped wedge member is then pressed into a tapered bore in the concrete at the dead anchor and the cable is subsequently pulled with great force at the live anchor end. The live anchor automatically grips the cable as it stretches and slides through the live anchor. Soum and Burtelson address the issue of pre-stressing concrete, but not in the context of the problem of strengthening a concrete shell of a buoyant module subject to impact during wave action.

It is thus an object of the present invention to provide a method of fabricating buoyant modules suitable for assembling into various floating structures including docks, bridges, support surfaces for buildings such as restaurants and floating breakwater structures.

It is another object of the present invention to provide a method which produces a module which is efficient and effective in performing the function of floating structure support and yet is aesthetically pleasing.

It is another object of the present invention to provide such a method which produces a module having the large mass and durability imparted by a concrete exterior shell and the fracture resistance achieved by pre-stressing the exterior shell.

It is still another object of the present invention to provide such a method which produces a module not subject to sinking in the unlikely event that the concrete exterior ruptures, because the interior is filled with highly buoyant foam material.

It is finally an object of the present invention to provide such a method which is cost effective for its various uses and is relatively easy to deploy, and to provide an efficient method of floating structure assembly.

SUMMARY OF THE INVENTION

The present invention accomplishes the above-stated objectives, as well as others, as may be determined by a fair reading and interpretation of the entire specification.

A method is provided for fabricating on a production line basis a plurality of buoyant building modules, which, as to each such module, includes the steps of preparing a bed having the desired module shape and size; preparing a galvanized welded wire fabric or mesh; fitting said wire fabric along the floor and sidewall interior surfaces of the bed to begin building an infrastructure; installing and tying epoxy coated reinforcing bars, inserts, reinforcing plates, post tensioning tubes and other reinforcing steel within said infrastructure; installing pre-stressing strand along floor and sidewall interior surfaces; applying tensile loading to the pre-stressing strands with a hydraulic jack and deadhead apparatus; pouring a layer of concrete on the floor of the bed; seating foam billets within billet receiving sections adjacent to the wire fabric and between the post-tensioning tubes; preparing a further galvanized welded wire fabric or mesh for the interior deck over the foam billets; fitting said wire fabric along said interior deck to build the remainder of the infrastructure; installing and tying epoxy coated reinforcing bars and other reinforcing steel within the interior deck portion of the infrastructure and connecting the same to the sidewall infrastructure; installing pre-stressing strand along the interior deck portion of the infrastructure; applying tensile loading to the interior deck pre-stressing strands with the hydraulic jack and deadhead apparatus; pouring cement mix into the bed around and over the foam billets; applying a smooth brush finish to the module; permitting the cement mix to cure; cutting the pre-stressing strand ends; and removing the module from the bed.

A method is also provided of assembling buoyant modules including a buoyant billet surrounded by concrete, where the concrete contains pre-stressed strands; and a post-tensioning tube embedded in the concrete and passing through the module, into a composite structure, including the steps of selecting a floating structure assembly site; transporting several modules to the floating structure assembly site; juxtaposing the modules, so that the post-tensioning tubes of laterally adjacent modules are mutually aligned; inserting post-tensioning means through the tubes; applying tension to the post-tensioning means with a tensioning tool; and anchoring the post-tensioned means in place. If the modules are to be utilized in the context of a floating breakwater, then the method of assembly preferably also includes the additional steps of juxtaposing the modules in staggered fashion in at least two longitudinal rows; positioning pilings a distance apart corresponding to the length of one module and driving the pilings into the seabed at the floating structure assembly site. Where the modules have notches recessed into their end walls, also included is fitting the notches around the pilings.

A buoyant building module is provided, including a buoyant billet surrounded by concrete, where the concrete contains pre-stressed strands. The buoyant billet is preferably a plastic foam billet. The module preferably includes several of the foam billets in a linear series and spaced apart from each other, where the concrete both encases and interconnects the foam billets. The foam billets are preferably elongate and are oriented and positioned longitudinally within the module. The module preferably additionally includes wire fabric contained within the concrete. The module preferably additionally includes a post-tensioning tube embedded in the concrete and passing through the module. Where the module includes a module side wall, the module optionally includes a notch for laterally receiving a piling. The module preferably additionally includes module side walls and resilient bumper material secured along the side walls for abutting an adjacent module without incurring impact and abrasion damage. The module also preferably includes resilient bumper material secured within the notches for abutting a piling without incurring impact and abrasion damage.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
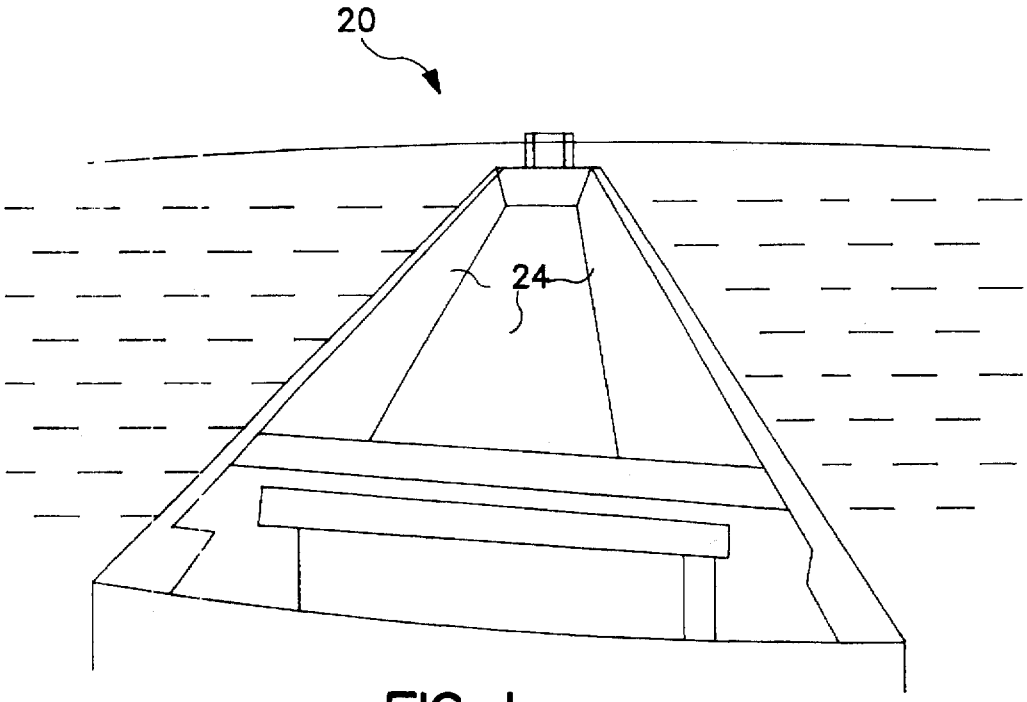
FIG. 1 is a perspective view of a module bed.
Figure 2:
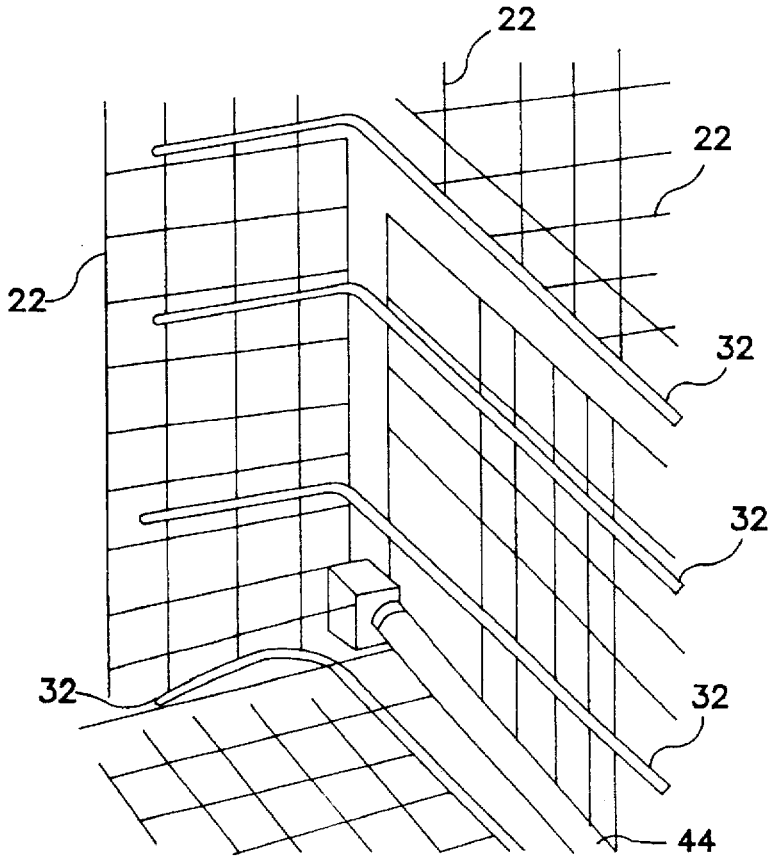
FIG. 2 is a perspective view of a portion of wire fabric and re-bars for lining the module bed. The mesh includes a lateral bulkhead segment to divide the bed into billet receiving sections.
Figure 3:
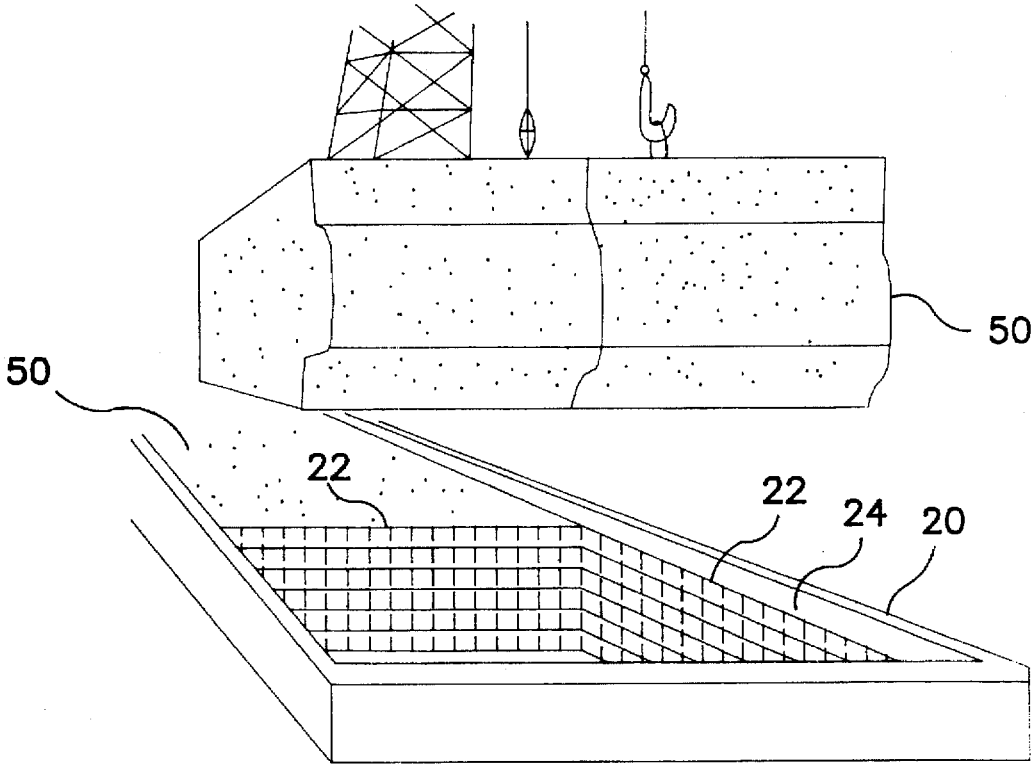
FIG. 3 is perspective view of a module bed lined with the wire fabric and re-bars. One billet is shown seated in a billet receiving section and another billet is shown being lowered by a crane into a vacant billet receiving section.
Figure 4:
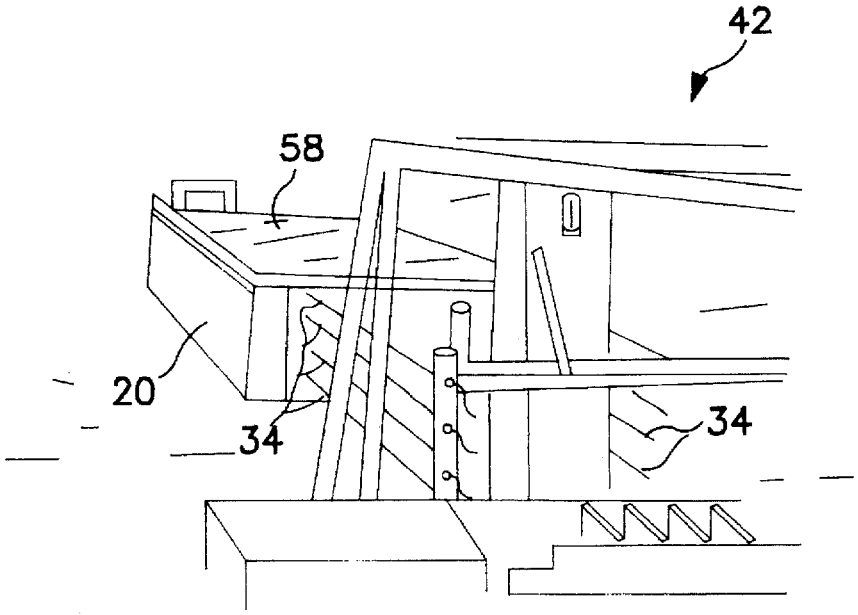
FIG. 4 is a perspective end view of a module bed into which wet cement mix has just been poured. Pre-stressing strands extend through and out of the bed and are shown connected to a hydraulic jack and deadhead tensioning apparatus.
Figure 5:
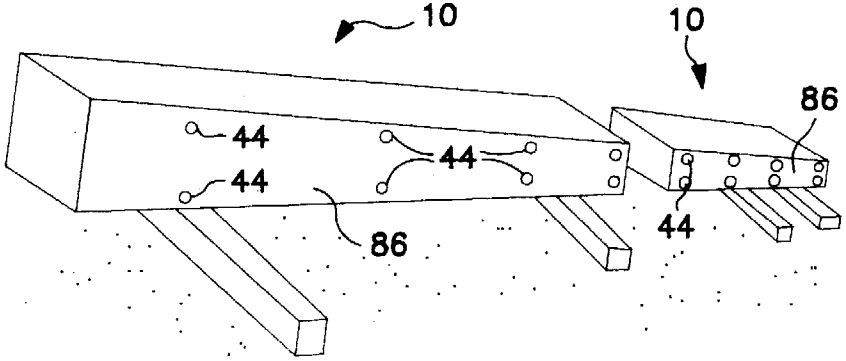
FIG. 5 is a perspective side view of two completed modules resting on concrete support beams, and revealing pairs of upper and lower post-tensioning tubes opening out of the module sides.
Figure 7:
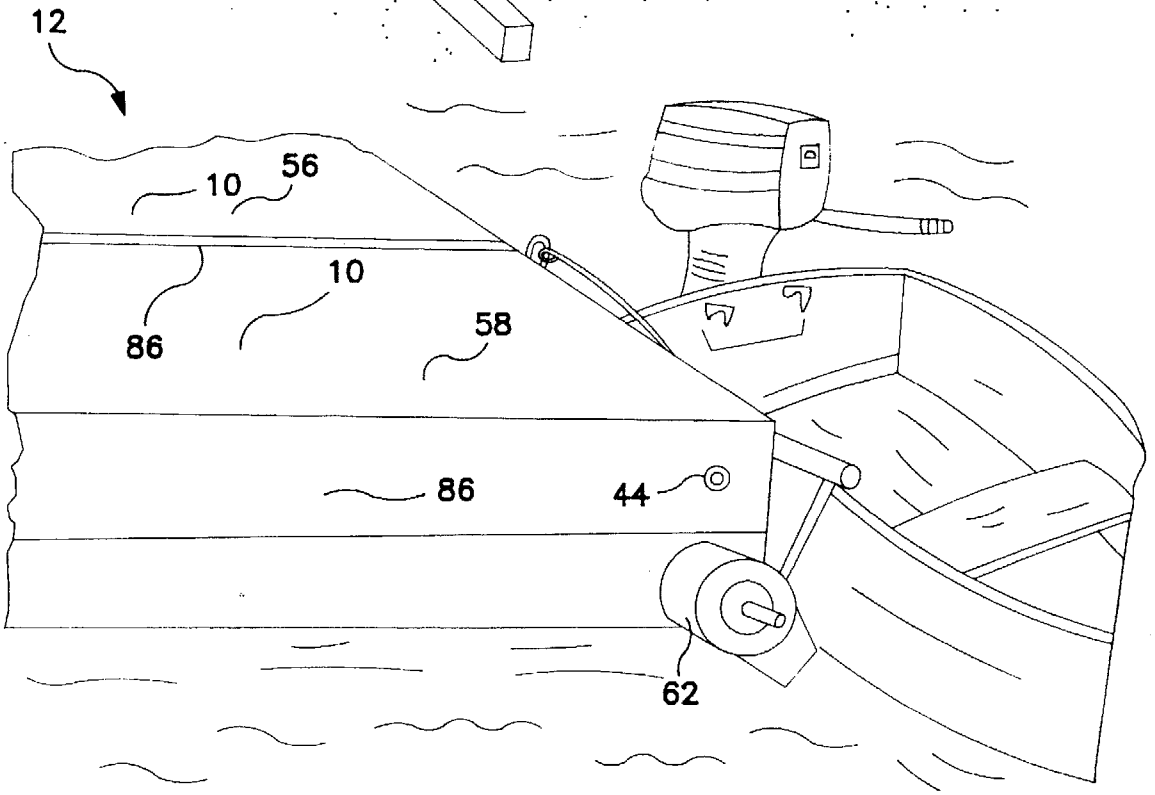
FIG. 7 is a perspective view of a module being secured to an adjacent module by stretching post-tensioning means, such as a rod, passing through both modules with a suitable apparatus.
Figure 6:
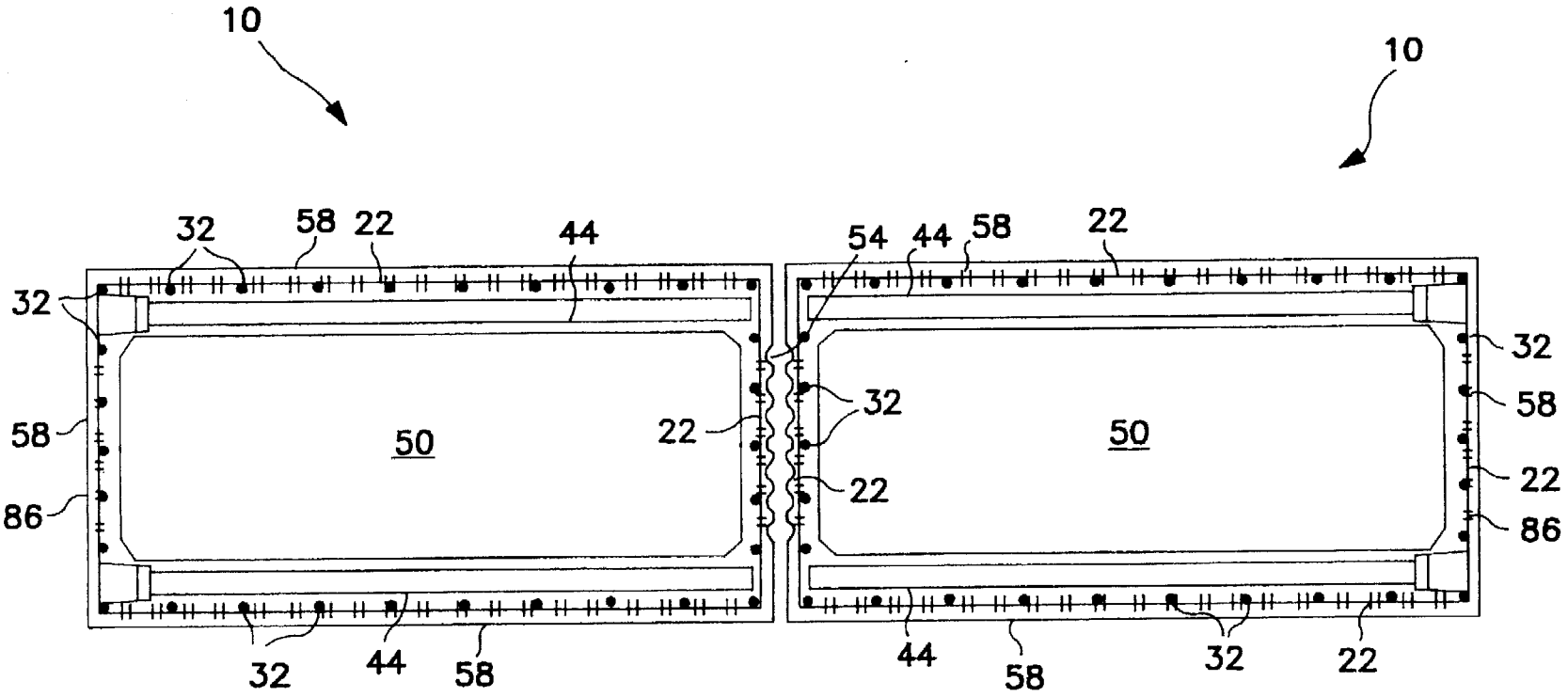
FIG. 6 is a cross-sectional end view of two adjacent modules having a layer of grout between them.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed floating structure. In this connection, it should be particularly understood that the essence of the invention is embodied in the method of fabricating the module, which has broad use in supporting floating structures, and that the described use in connection with a floating breakwater is merely an illustration of the use of module and not a limitation of the invention.

Reference is now made to the drawings, wherein like characteristics and features of the present invention shown in the various FIGURES are designated by the same reference numerals.

Preferred Method of Module Fabrication

A method is disclosed as illustrated in FIGS. 1–7 of fabricating buoyant building modules 10 for assembling floating structures. The method includes the steps of creating a bed 20 having the desired module 10 shape and size (See FIG. 1); preparing a galvanized welded wire fabric 22 or mesh (See FIG. 2); fitting the wire fabric 22 along the floor and sidewall interior surfaces 24 of bed 20 to begin building an infrastructure and laterally across the interior of bed 20 to divide the interior into billet receiving sections 26; installing and tying epoxy coated reinforcing bars 32 and other reinforcing steel within said infrastructure along the interior surfaces 24 of bed 20 supported by wire fabric 22; fitting sets of upper and lower post-tensioning tubes 44 laterally within and completely across the interior of bed 20 to abut longitudinal interior surfaces 24 through wire fabric 22; installing pre-stressing strands 34 along floor and sidewall interior surfaces within bed 20 and through wire fabric 22; applying tensile loading to pre-stressing strands 34 with a hydraulic jack and deadhead apparatus 42 and securing the loaded strands (See FIG. 4); pouring cement mix 58 into the bottom of bed 20; seating foam billets 50 within billet receiving sections 26 adjacent to wire fabric 22, between sets of post-tensioning tubes 44 and onto cement mix 58 (See FIG. 3); preparing a further galvanized welded wire fabric 22 for the interior deck over the foam billets 50; fitting said wire fabric 22 along said interior deck to build the remainder of the infrastructure; installing and tying epoxy coated reinforcing bars 32 and other reinforcing steel within the interior deck portion of the infrastructure and connecting the same to the sidewall infrastructure; installing pre-stressing strand 34 along the interior deck portion of the infrastructure; applying tensile loading to the interior deck pre-stressing strands with the hydraulic jack and deadhead apparatus 42; pouring cement mix 58 into bed 20 around and over foam billets 50; applying a smooth brush finish to the top of the module 10 (See FIG. 5); permitting the cement mix 58 to cure; and removing the module 10 from the bed 20.

If the modules are to be used in a floating breakwater structure or a side by side module application, a preferred method of assembling the modules is described hereinafter. Assembly of modules 10 formed according to the above method into a floating structure 12 includes the steps of transporting a several modules 10 to a floating structure assembly site; optionally pouring grout key 54 within the module 10 side surfaces (See FIG. 4); juxtaposing the modules 10, preferably longitudinally in staggered fashion in two module 10 rows end 74 to end 74, such that the post-tensioning tubes 44 of laterally adjacent modules 10 are mutually aligned; inserting post-tensioning means 56 through post-tensioning tubes 44; applying tension to post-tensioning means 56 with a hydraulic tensioning tool 62 (See FIG. 6); and anchoring post-tensioned means 56 in place.

Figure 8:
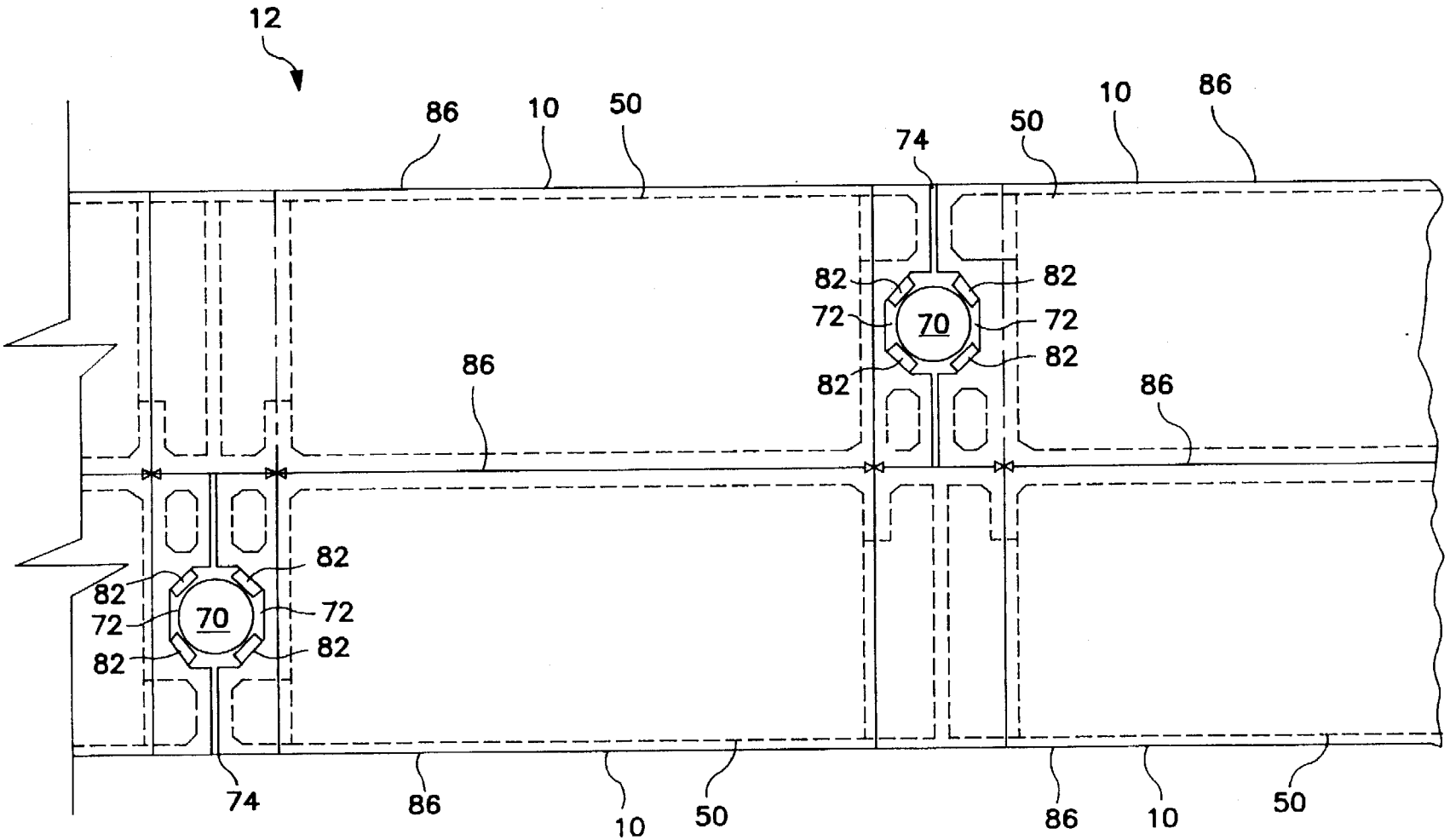
FIG. 8 is a top view of an assembled module floating structure arranged in two laterally abutting rows of longitudinally oriented modules, such would occur when the modules are employed in a floating breakwater structure. These modules are shown having end notches which are fit around pilings for anchoring the assembled floating structure. Blocks of bumper material are shown within the notches.
Figure 9:
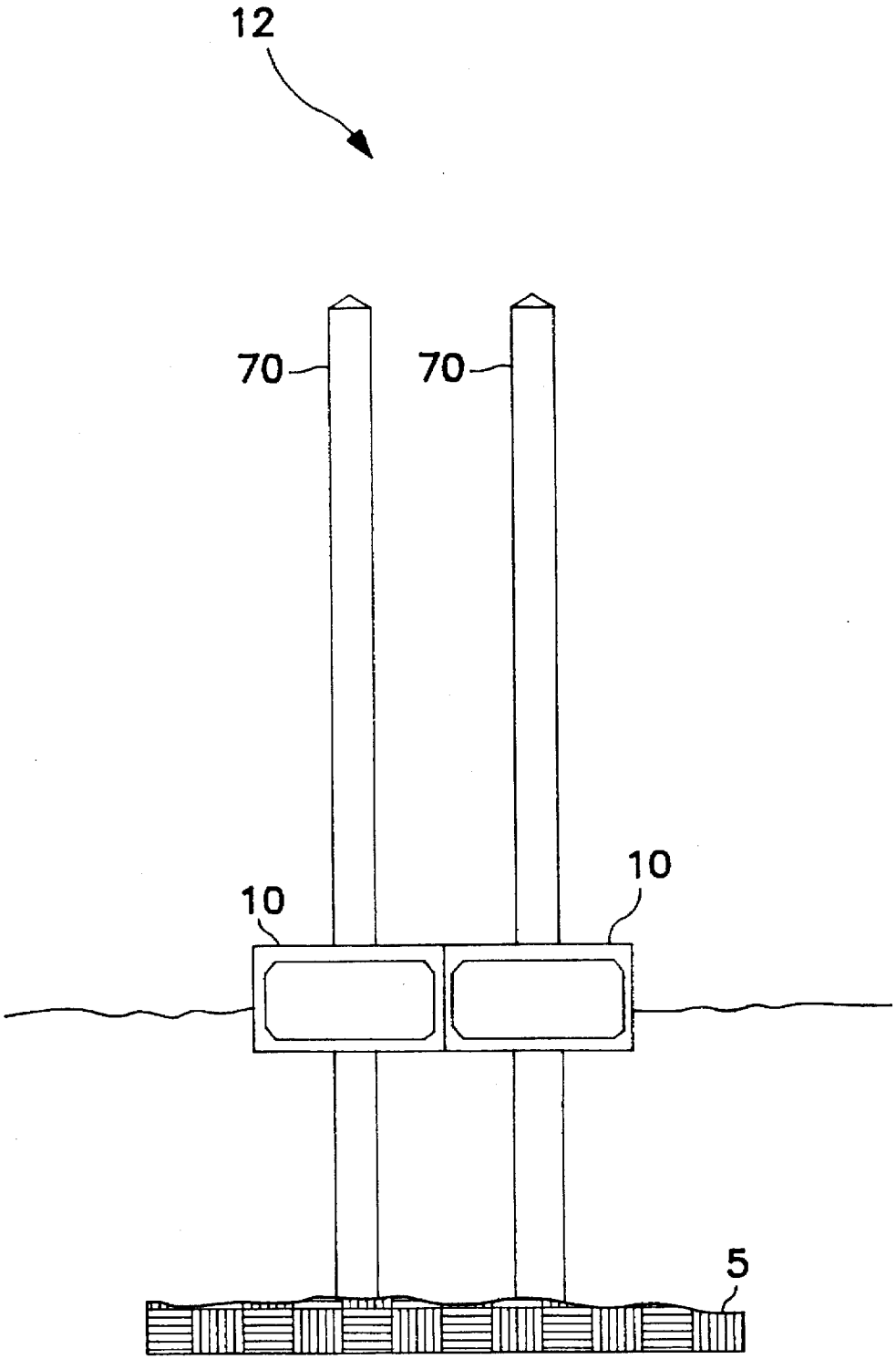
FIG. 9 is a side view of an assembled floating breakwater structure, showing the body of water and seabed S in cross-section at high tide.
Figure 10:
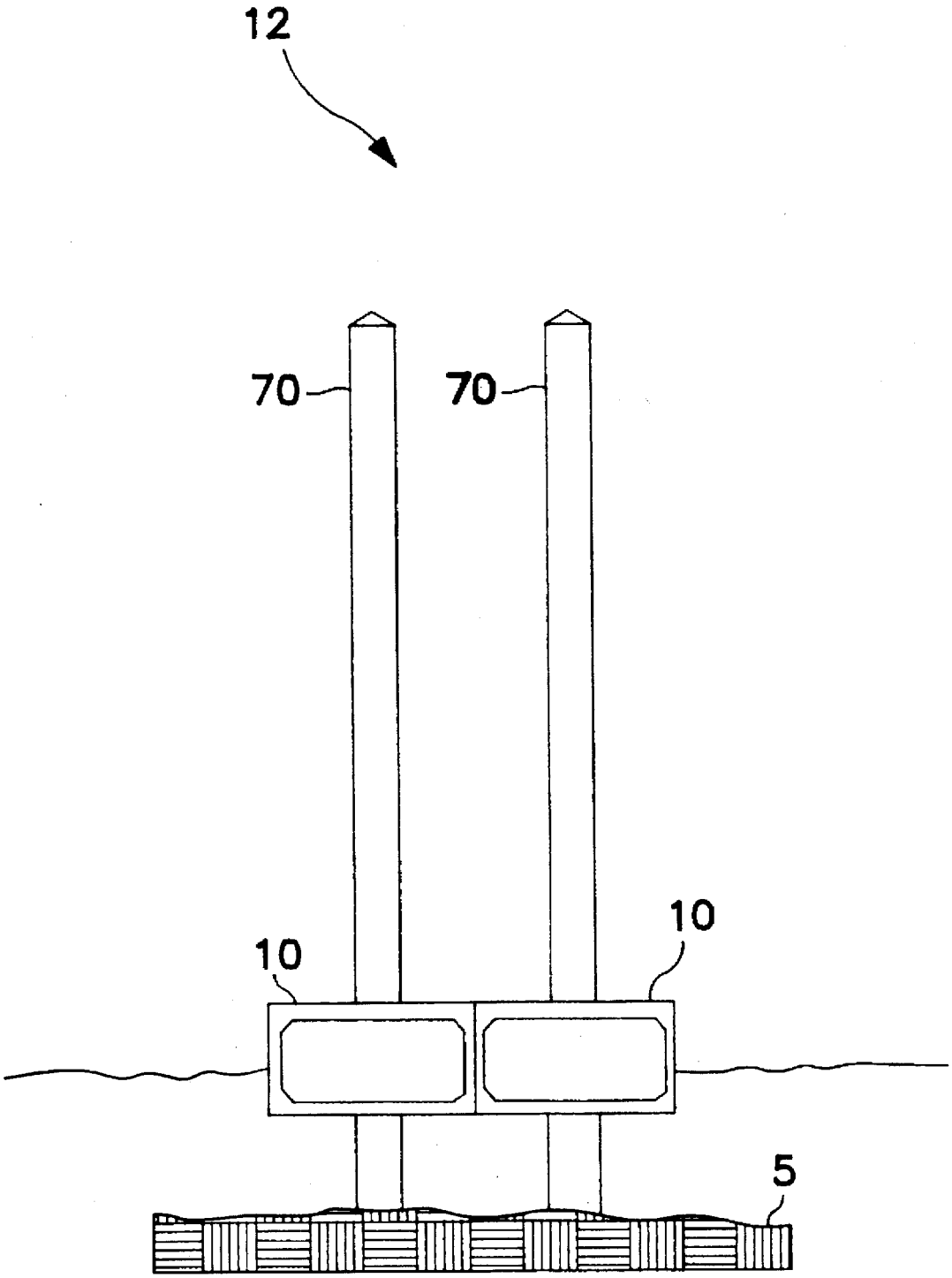
FIG. 10 is a side view of an assembled floating breakwater structure as in FIG. 9, at low tide.

Floating structure 12 may be anchored in several ways. The preferred way is to drive pilings 70 into the seabed S at the building site, a distance apart from each other corresponding to the length of a module 10. The modules 10 preferably have notches 72 recessed into their end walls 74 to each laterally receive approximately half the width of a piling 70 (See FIG. 8). Thus an additional step is to fit notches 72 of opposing modules 10 around pilings 70. See FIGS. 9–10, which show changing module 10 elevations along pilings 70 with changing tide. Alternatively the notches 72 are omitted and modules 10 are anchored to the seabed S by conventional means. The module assembly can be anchored by either pilings or a mooring configuration utilizing nylon lines and/or chains which is anchored with concrete blocks.

Preferred Embodiment of Module

Figure 11:
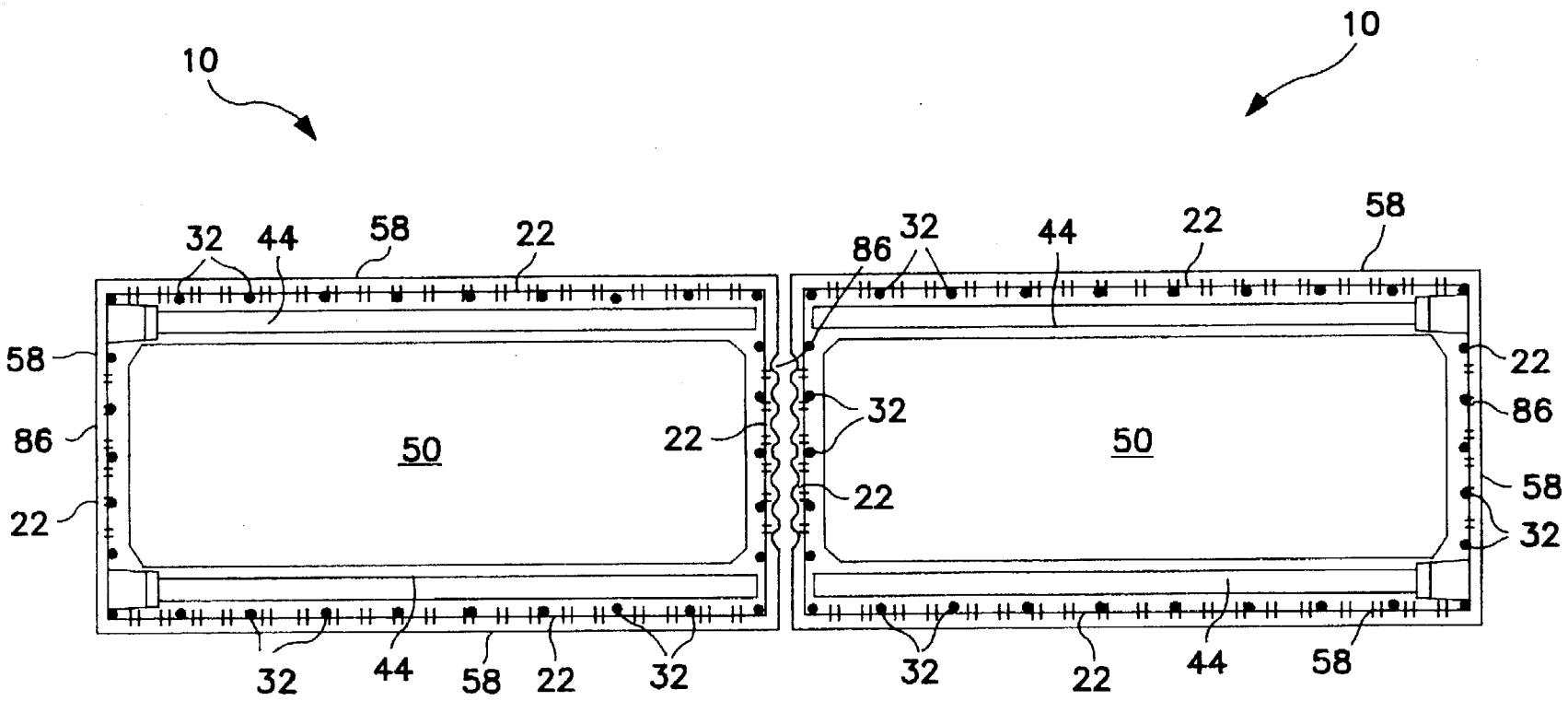
FIG. 11 is a cross-sectional end view of two adjacent modules having bumper material secured between them.
Figure 12:
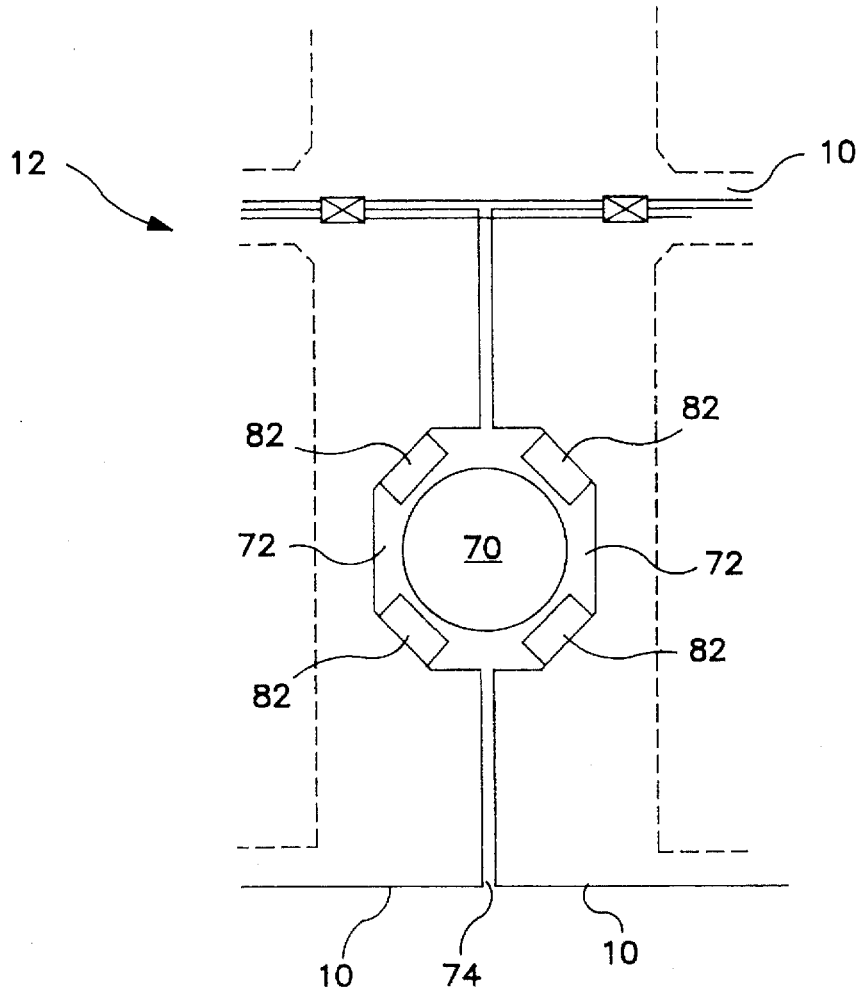
FIG. 12 is a close-up top view of abutting ends of two modules in an assembled floating structure, illustrating the relationship between the notches, bumper material and a piling.
Figure 13:
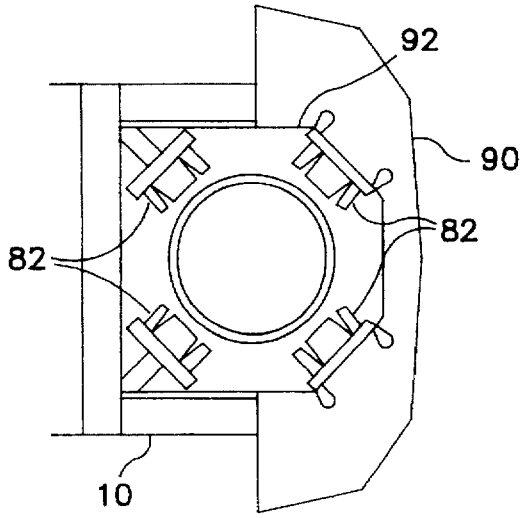
FIG. 13 is a close-up top view of a notched end of a module in an assembled floating structure fit laterally around a piling, and an end cap also having a notch and fit around the piling, the end cap being secured to the end of the module to contain the piling.
Figure 14:
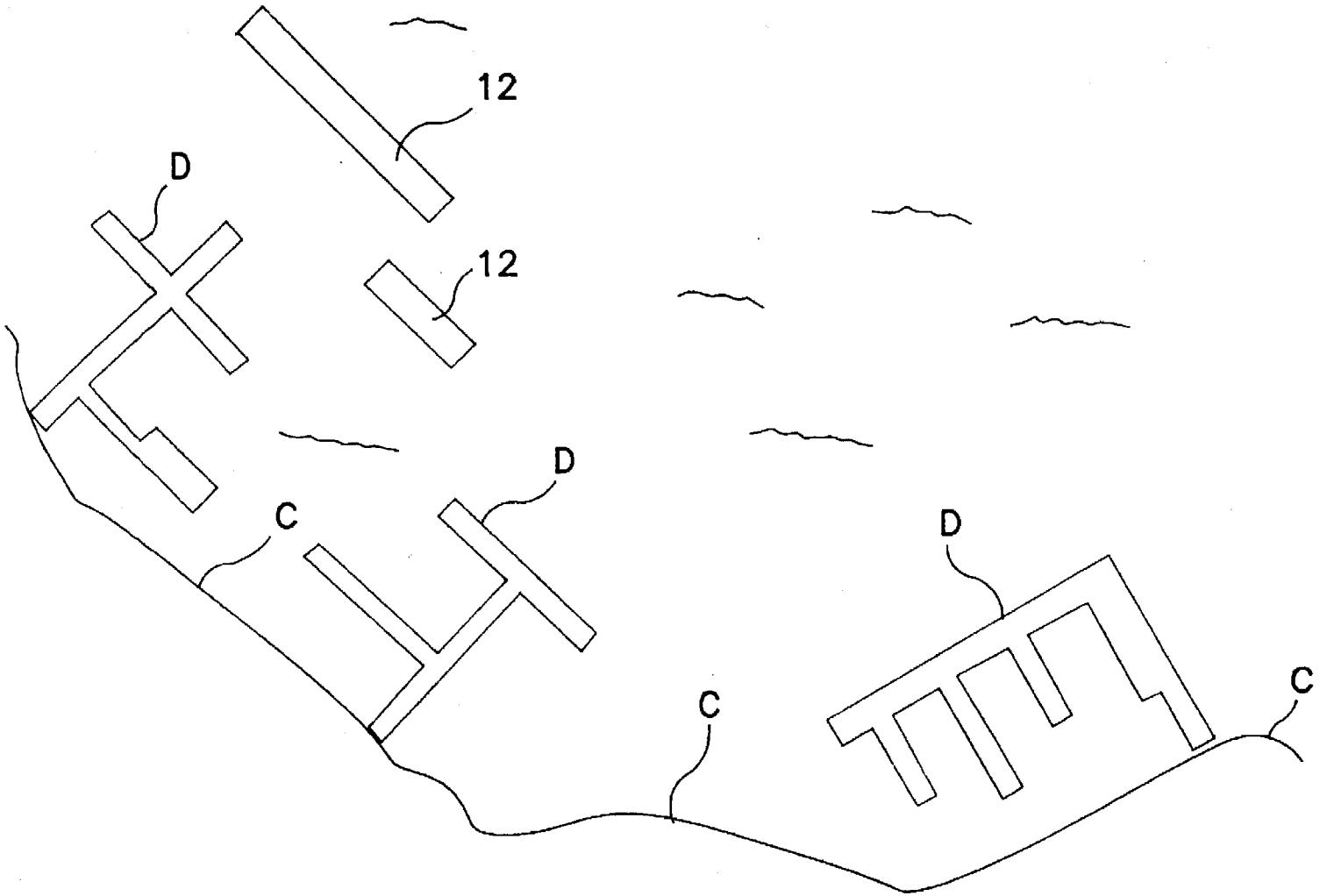
FIG. 14 is a schematic aerial view of a coastline C and a harbor or dock D protected by a typical floating breakwater structure.

In practicing the method set forth above, a module 10 having the following characteristics is fabricated. See FIGS. 5–13. This module 10 includes a linear series of spaced apart foam billets 50, the series being surrounded by concrete 58 to both encase and interconnect the foam billets 50. The concrete 58 contains galvanized welded wire fabric 22 and pre-stressing strands 34, preferably arranged longitudinally within the module 10 and along or through wire fabric 22. Pairs of upper and lower post-tensioning tubes 44 are embedded in concrete 58 and preferably pass laterally through the module 10, at both ends of module 10 and also between foam billets 50. A piling receiving notch 72 is optionally recessed into the concrete 58 at one or both end walls 74 of the module 10. In conjunction with the grout key 54, blocks 82 of bumper material such as neoprene are preferably provided along the exterior side walls 86 and end walls 74 of the module 10 for abutting an adjacent module 10 without impact and abrasion damage to the either module 10 (See FIG. 11). Similar blocks 82 are also preferably provided within notches 72 to permit safe abutment with pilings 70 (See FIG. 12). Pilings 70 are driven into the seabed S prior to module 10 deployment. An end cap 90 with a notch 92 may retain a piling 70 at a floating structure 12 end.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

What is claimed is:

1. A method of fabricating a buoyant building module, comprising the steps of:

providing a bed having a desired module shape and size, and having bed interior surfaces;

extending pre-stressing strands through said bed;

applying tensile loading to said pre-stressing strands with tensile loading application means;

seating a buoyant billet within said bed, between said prestressing strands;

extending pre-stressing strands through said bed above said bouyant billet;

applying tensile loading to said pre-stressing strands with tensile loading application means;

pouring cement mix into said bed around and over said buoyant billet;

permitting said cement mix to cure; and removing said module from said bed.

2. The method of claim 1, additionally comprising the steps of:

preparing a galvanized welded wire fabric; and fitting said welded wire fabric along said bed interior surfaces.

3. The method of claim 2, additionally comprising the step of fitting said wire fabric laterally across the interior of said bed to divide the interior of said bed into buoyant billet receiving sections.

4. The method of claim 1, additionally comprising the step of placing reinforcing bars along said bed interior surfaces.

5. The method of claim 3, additionally comprising the step of fitting post-tensioning tubes through said bed, and through said wire fabric at both ends of said bed.

6. The method of claim 5, additionally comprising the step of fitting post tensioning tubes along said wire fabric.

7. The method of claim 1, applying a smooth brush finish to said module.

8. A method of fabricating a buoyant building module, comprising the steps of:

preparing a bed having the desired module shape and size; preparing a welded wire fabric;

fitting said wire fabric along the floor and sidewall interior surfaces of the bed to begin building an infrastructure;

installing and tying reinforcing bars, inserts, reinforcing plates, post-tensioning tubes and other reinforcing steel within said infrastructure;

installing pre-stressing strand along floor and sidewall interior surfaces;

applying tensile loading to the pre-stressing strands with a hydraulic jack and deadhead apparatus;

pouring a layer of concrete on the floor of the bed;

seating foam billets within billet receiving sections adjacent to the wire fabric and between the post-tensioning tubes;

preparing a further welded wire fabric for the interior deck over the foam billets;

fitting said wire fabric along said interior deck to build the remainder of the infrastructure;

installing and tying reinforcing bars and other reinforcing steel within the interior deck portion of the infrastructure and connecting same to the sidewall infrastructure;

installing pre-stressing strand along the interior deck portion of the infrastructure;

applying tensile loading to the interior deck pre-stressing strands with the hydraulic jack and deadhead apparatus;

pouring cement mix into the bed around and over the foam billets;

applying a smooth brush finish to the module;

permitting the cement mix to cure;

cutting the pre-stressing strand ends; and removing the module from the bed.

9. A method of assembling buoyant modules comprising a buoyant billet surrounded by concrete, wherein said concrete contains pre-stressed strands; and a post-tensioning tube embedded in said concrete and passing through said module, into a composite floating structure, comprising the steps of:

selecting a floating structure assembly site;

transporting a plurality of said modules to said floating structure assembly site;

juxtaposing said modules, such that said post-tensioning tubes of adjacent said modules are mutually aligned;

inserting post-tensioning means through said tubes;

applying tension to said post-tensioning means with a tensioning tool; and anchoring said post-tensioned means in place.

10. The method of claim 9, wherein said modules are juxtaposed in staggered fashion in at least two longitudinal rows.

11. The method of claim 9, additionally comprising the step of positioning pilings a distance apart corresponding to the length of one said module and driving said pilings into the seabed at said floating structure assembly site.

12. The method of claim 11, wherein said modules have notches recessed into their end walls, and additionally comprising the step of fitting said notches around said pilings.

* * * * *